US009062917B2

(12) United States Patent
Offutt

(10) Patent No.: US 9,062,917 B2
(45) Date of Patent: Jun. 23, 2015

(54) GASIFIER HAVING A SLAG BREAKER AND METHOD OF OPERATING THE SAME

(71) Applicant: InnerPoint Energy Corporation, Kirkwood, MO (US)

(72) Inventor: Gene Offutt, House Springs, MO (US)

(73) Assignee: InnerPoint Energy Corporation, Kirkwood, MO (US)

( * ) Notice: Subject to any disclaimer, the term of this patent is extended or adjusted under 35 U.S.C. 154(b) by 0 days.

(21) Appl. No.: 14/460,034

(22) Filed: Aug. 14, 2014

(65) Prior Publication Data

US 2014/0352214 A1 Dec. 4, 2014

Related U.S. Application Data

(63) Continuation of application No. 13/468,758, filed on May 10, 2012, now Pat. No. 8,919,265.

(60) Provisional application No. 61/484,486, filed on May 10, 2011.

(51) Int. Cl.

| | |
|---|---|
| ***F23J 1/00*** | (2006.01) |
| ***F27D 25/00*** | (2010.01) |
| ***C10J 3/08*** | (2006.01) |
| ***B08B 1/00*** | (2006.01) |
| ***C10J 3/30*** | (2006.01) |
| ***C10J 3/74*** | (2006.01) |
| ***C10J 3/76*** | (2006.01) |
| ***C10J 3/72*** | (2006.01) |
| *F23J 1/08* | (2006.01) |

(52) U.S. Cl.

CPC ..... *F27D 25/001* (2013.01); *F23J 1/00* (2013.01); *B08B 1/008* (2013.01); *F23J 2700/001* (2013.01); *F23J 1/08* (2013.01); *C10J 3/08* (2013.01); *F23J 2900/01007* (2013.01); *C10J 2200/36* (2013.01); *C10J 3/30* (2013.01); *C10J 3/74* (2013.01); *C10J 3/76* (2013.01); *C10J 2300/0916* (2013.01); *C10J 2300/0946* (2013.01); *C10J 2300/0956* (2013.01); *C10J 2300/0973* (2013.01); *C10J 3/72* (2013.01)

(58) Field of Classification Search

CPC ..... F23J 1/08; F23J 2700/00; F23J 2700/001; F23J 2700/002; F23J 2700/003; F27D 25/00; F27D 25/001; F27D 25/005; B08B 1/008; C10J 3/08

USPC ..... 110/259, 328, 348; 15/105.03, 104.16; 202/241; 266/135

See application file for complete search history.

(56) References Cited

U.S. PATENT DOCUMENTS

| | | | | |
|---|---|---|---|---|
| 3,437,561 | A * | 4/1969 | Squires | 201/8 |
| 7,947,216 | B2 * | 5/2011 | Pingel | 266/135 |
| 8,919,265 | B2 * | 12/2014 | Offutt | 110/341 |

* cited by examiner

*Primary Examiner* — David J Laux
(74) *Attorney, Agent, or Firm* — Thompson Coburn LLP

(57) ABSTRACT

A gasifier comprises an internal chamber, a slag collection region, a slag passageway, a slag breaker, and an actuator. The internal chamber comprises a main combustion region that is configured and adapted to gasify fuel. The slag collection region is located beneath the main combustion region. The slag passageway operatively connects the main combustion region to the slag collection region. The slag breaker comprises a face that is movable relative to the internal chamber. The face is configured and adapted to move within the slag passageway in a manner such that the face contacts and mechanically breaks solidified slag into chunks of solidified slag that then fall into the slag collection region. The actuator is connected to the slag breaker and is configured and adapted to move the face of the slag breaker.

4 Claims, 4 Drawing Sheets

GASIFIER HAVING A SLAG BREAKER AND METHOD OF OPERATING THE SAME

CROSS-REFERENCE TO RELATED APPLICATIONS

This application is a continuation patent application of non-provisional patent application Ser. No. 13/468,758, which was filed on May 10, 2012, currently pending, which claims the benefit of provisional patent application Ser. No. 61/484,486, filed on May 10, 2011.

STATEMENT REGARDING FEDERALLY SPONSORED RESEARCH OR DEVELOPMENT

Not Applicable.

APPENDIX

Not Applicable.

BACKGROUND OF THE INVENTION

1. Field of the Invention

This invention pertains to gasifiers. More particularly, the present invention pertains to a gasifier equipped with a slag breaker that breaks solidified slag into small chucks of slag that can then easily be discharged from the gasifier. The slag breaker allows slag accumulation within the gasifier to reach an equilibrium and eliminates the need to periodically shutdown the gasifier to remove solidified slag accumulations.

2. General Background

During the gasification process of some fuels, such as wood, grass, and other biofuels, ash is produced as a byproduct. The combustion chamber of some gasifiers operate at temperatures wherein the ash formed during the combustion process liquefies and thereby becomes slag. Such liquified slag often flows down the walls that surround the combustion chamber and either collects at the bottom of the combustion chamber or is discharged from a port at the base of the combustion chamber. After leaving the combustion chamber or after the gasifier has been shutdown, the liquified slag cools and solidifies. The solidified slag is much more difficult than ash to dispose of and manage due to its rigid nature. Moreover, solidified slag can accumulate in undesirable places within a gasifier and can block critical passageways. Thus, dealing with solidified slag can be problematic to the operation of gasifiers.

SUMMARY OF THE INVENTION

The present invention provides a solution to the problem of dealing with solidified slag. A gasifier in accordance with invention is configured such that slag is intentionally solidified within the gasifier in form of slag stalactites. A slag breaker periodically breaks the stalactites within the gasifier via impact. The broken slag stalactite chunks then fall into a slag collection region. The broken slag stalactite chunks are small and can be removed from the gasifier much more easily than can a solidified blob of slag or slag that solidified while in contact with a surface of a component of the gasifier.

In one aspect of the invention, a gasifier comprises an internal chamber, a slag collection region, a slag passageway, a slag breaker, and an actuator. The internal chamber comprises a main combustion region that is configured and adapted to gasify fuel. The slag collection region is located beneath the main combustion region. The slag passageway operatively connects the main combustion region to the slag collection region. The slag breaker comprises a face that is movable relative to the internal chamber. The face is configured and adapted to move within the slag passageway in a manner such that the face contacts and mechanically breaks solidified slag into chunks of solidified slag that then fall into the slag collection region. The actuator is connected to the slag breaker and is configured and adapted to move the face of the slag breaker.

In another aspect of the invention, a method comprises gasifying fuel in an internal chamber of a gasifier in a manner creating liquified slag within the internal chamber. The method also comprises solidifying the liquified slag into solidified slag within the gasifier. Furthermore, the method comprises operating an actuator in a manner causing a face of a slag breaker to move into contact with the solidified slag in a manner causing the solidified slag to break into chunks of solidified slag that then fall into a slag collection region of the gasifier. Still further, the method comprises operating a slag removal device in a manner expelling at least some of the chunks of the slag in the slag collection region from the gasifier.

Further features and advantages of the present invention, as well as the operation of the invention, are described in detail below with reference to the accompanying drawings.

Figure 1:
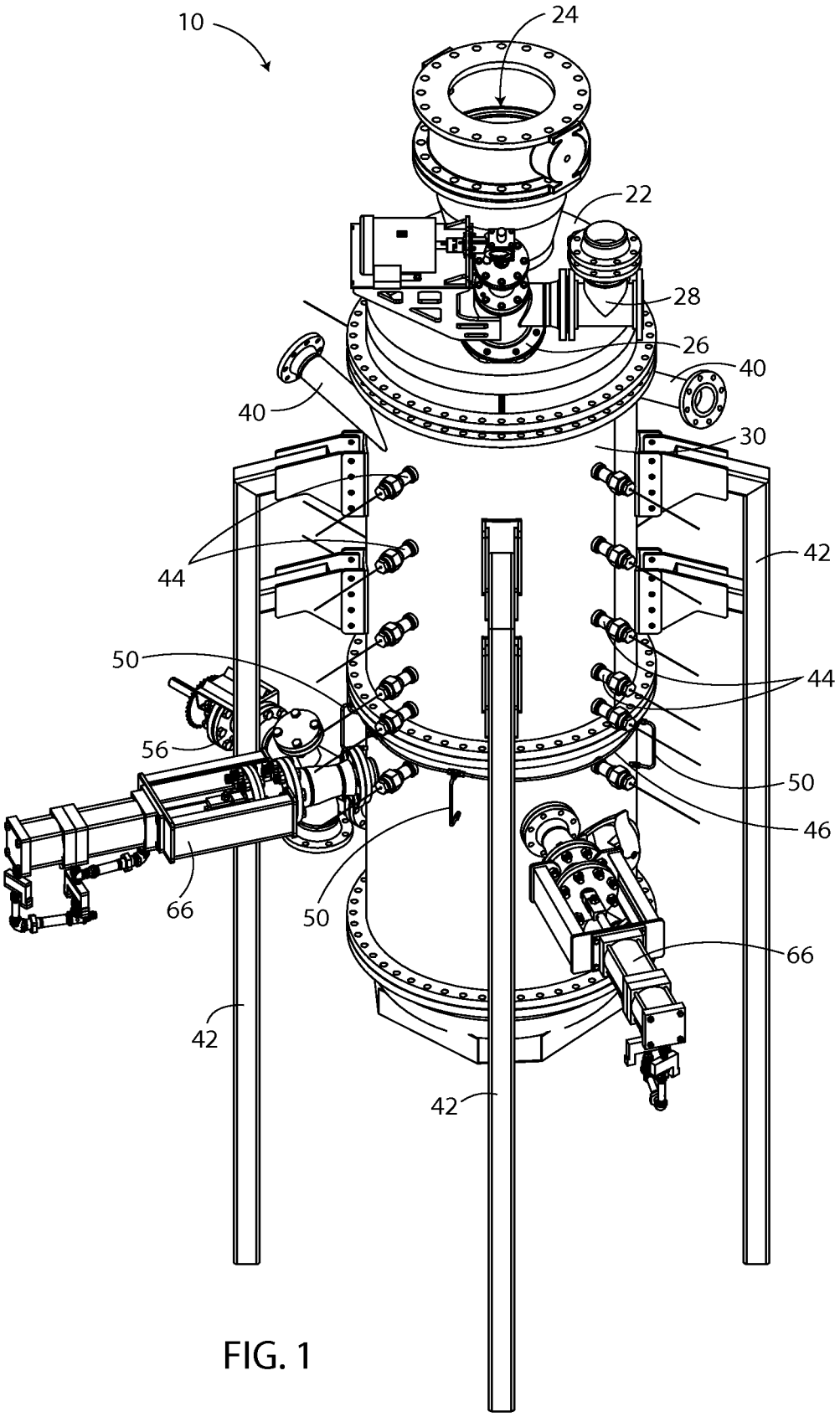
FIG. 1 depicts a perspective view of a gasifier in accordance with the invention.

Reference numerals in the written specification and in the drawing figures indicate corresponding items.

DETAILED DESCRIPTION

Figure 2:
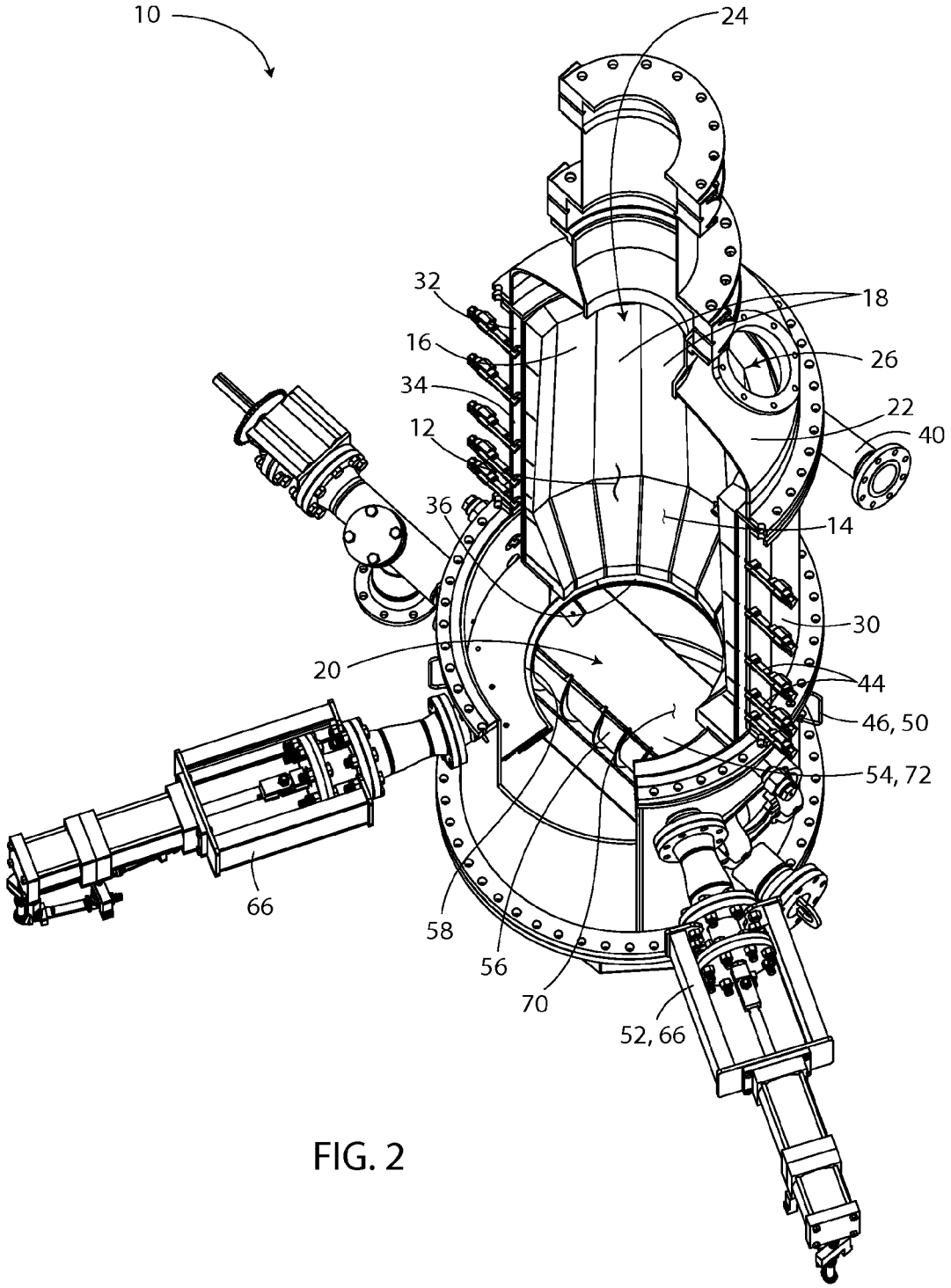
FIG. 2 depicts a perspective of view of the gasifier shown in FIG. 1, with portions of the gasifier cut-away to show the interior of the gasifier.
Figure 3:
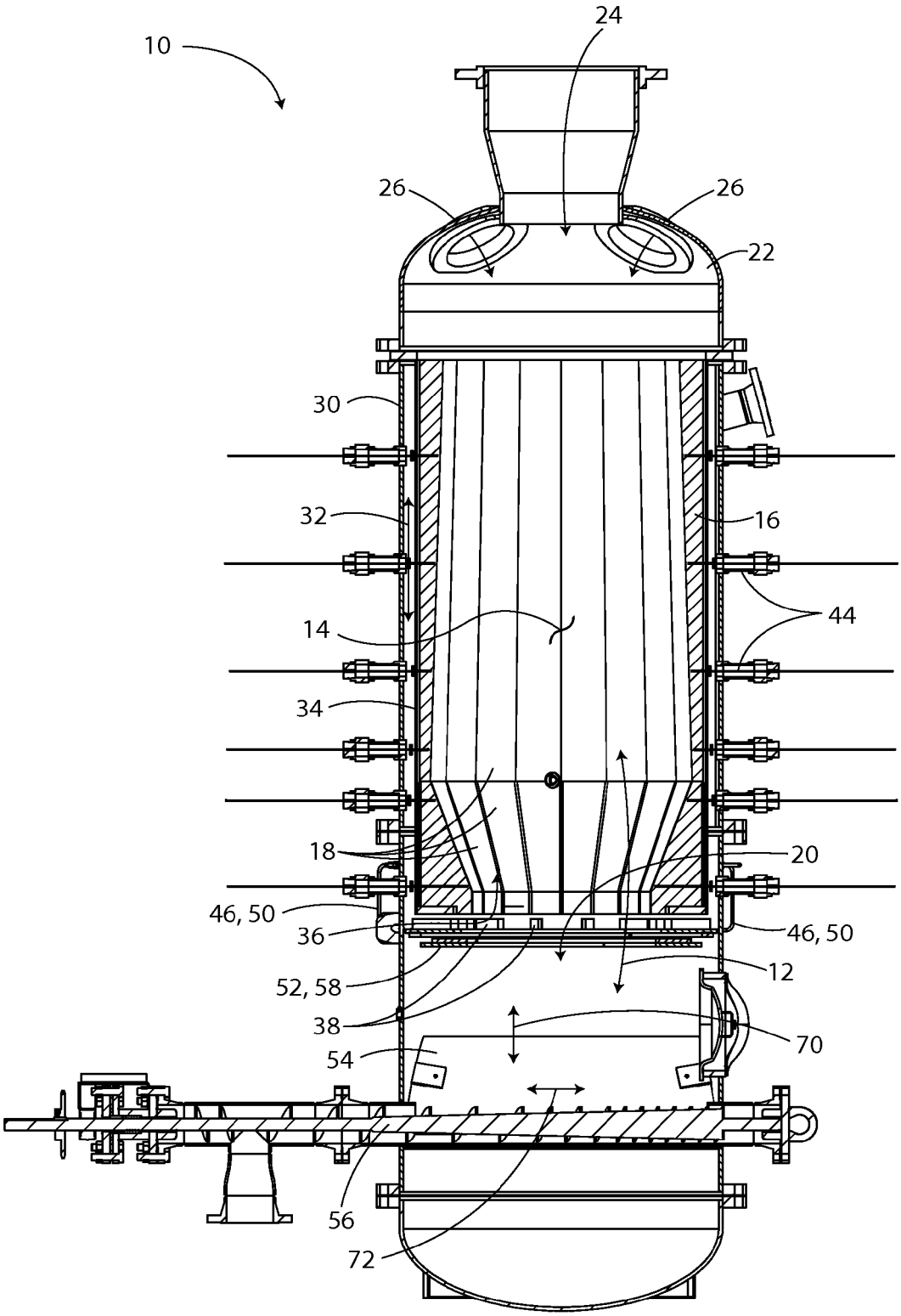
FIG. 3 depicts a cross-section of the gasifier shown in FIGS. 1 and 2.

A gasifier in accordance with the invention is shown in FIG. 1-3. The gasifier 10 is configured to gasify bio-fuels, petroleum based fuels, and virtual any type of fuel that can be gasified. The gasifier 10 comprises an internal chamber 12 that has a main combustion region 14. The main combustion region 14 is encircled by a ceramic wall 16 that is formed out of a plurality of ceramic blocks 18. The base of the ceramic wall 16 converges radially inward as it extends downward to a centrally positioned slag outlet 20. The top of the main combustion region 14 is bounded by a dome-shaped top cover 22. The top cover 22 comprises a centrally positioned fuel inlet port 24 and a plurality of utility ports 26 spaced circumferentially around the fuel inlet port 24. As shown in FIG. 1, a gasified-fuel outlet tube 28 is operatively connected to at least one of the utility ports 26. The other utility ports 26 can serve as service access ports, ports for measuring equipment, additional fuel inlet ports, and as variety of other things. The top cover 22 is preferably bolted to the top of a cylindrical jacket 30 that encircles the ceramic wall 16. The cylindrical jacket 30 is radially spaced from the ceramic wall 16 in a manner forming a tubular air passageway 32 therebetween. The cylindrical jacket 30 also surrounds a support sleeve 34 that encircles the ceramic wall 16 and that provides structure for attaching the ceramic blocks 18 of the ceramic wall to each other. The tubular air passageway 32 is closed at its top and extends down the length of the ceramic wall 16 between the cylindrical jacket 30 and the support sleeve 34 and then radially inward beneath the ceramic wall to an annular air inlet 36 that lies directly beneath the slag outlet 20 of the main combustion region 14. A plurality of guide vanes 38 extend radially in the tubular air passageway 32 adjacent the annular air inlet 36 of the internal chamber 12. The guide vanes 38 help support and attach the bottom of the ceramic wall 16 to the outer cylindrical jacket 30. A pair of air inlet tubes 40 operatively connect the top portion of the tubular air passageway 32 to a source of controlled air flow (not shown). The air inlet tubes 40 extend through the cylindrical jacket 30 and are oriented in a tangential manner relative to the tubular air passageway 32.

The components described above form the basic structure of the gasifier 10. However, the gasifier 10 also comprises additional components such as the support legs 42 shown in FIG. 1, thermocouples 44, a water injection system 46, and a slag handling system. The support legs 42 are attached to the cylindrical jacket 30 of the gasifier 10 and are configured to support the gasifier above a surface. The thermocouples 44 are connected to the ceramic wall 16 and are adapted to monitor the temperature of the ceramic wall for aiding in controlling the operation of the gasifier 10. The water injection system 46 comprises a plurality of water lines 50 that extend through the cylindrical jacket 30 and between the guide vanes 38 toward the annular air inlet 36 of the internal chamber 12. The water lines 50 stop short of the annular air inlet 36 of the internal chamber 12 and terminate at nozzles (not shown) that are configured to discharge water into the air that flows through the anular air inlet 36. The slag handling system comprises several components that are described below.

Figure 4:
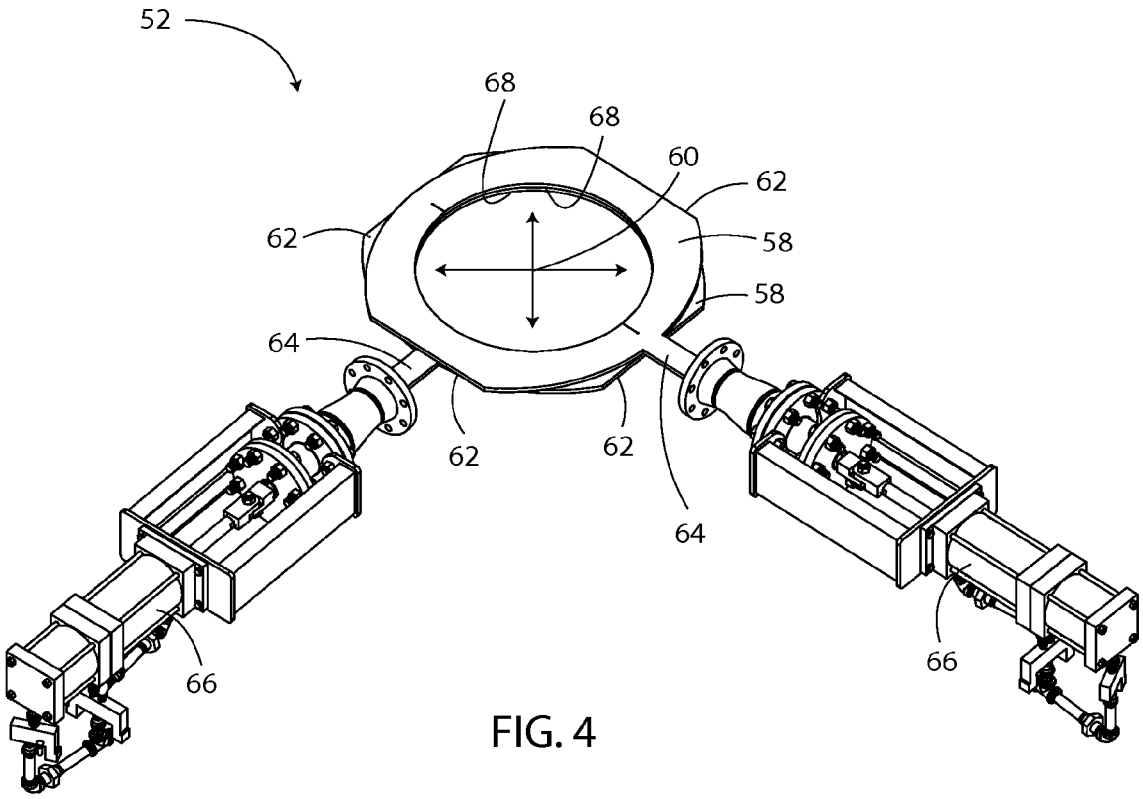
FIG. 4 depicts a perspective view of the slag breaker of the gasifier shown FIGS. 1-3.

The components of the slag handling system include a slag breaker 52 (shown by itself in FIG. 4), a slag chute 54, and a slag discharge auger 56. As shown in FIG. 4, the slag breaker 52 comprises a pair of actuator driven breaking members 58 oriented at a right angle to each other. Each breaking member 58 is a ring-shaped piece of steel plate material having a circular central opening 60, a pair of parallel guide edges 62, and a driving arm 64 that extends away from the circular central opening parallel to the guide edges. An actuator 66 is connected to the driving arm 64 of each breaking member 58 and is configured to move the breaking member 58 along a linear path in a reciprocating manner. The actuators shown in FIG. 4 are pneumatic actuators, but any type of actuator, such a hydraulic actuators or linear electric motors, could be utilized instead. The opening 60 of each breaking member 58 creates an internal cylindrical face 68 that, as explained below, is configured to engage and break solidified slag into small chunks during the operation of the gasifier 10. The slag breaker 52 is positioned directly beneath the annular air inlet 36 of the internal chamber 12. The internal cylindrical faces 68 of the breaking members 58 each have a diameter that is slightly larger than the slag outlet 20 of the main combustion region 14. Guide rails (not shown) are attached to the interior of the cylindrical jacket 20 and engage the guide edges 62 of the breaking members 58 to hold and guide the movement of the breaking members. The slag chute 54 is positioned beneath the slag breaker 52 and is configured to catch slag chunks broken by the slag breaker and deflect them toward and into the slag discharge auger 56.

In use, fuel is introduced into the main combustion region 14 of the gasifier 10 through the fuel inlet port 24 located on the top cover 22 of the gasifier. Additionally, air is introduced into the tubular air passageway 32 via the air inlet tubes 40. Due to the tangential orientation of the air inlet tubes 40 relative to the tubular air passageway 32, the air spirals downward in the tubular air passageway around the ceramic wall 16 of the gasifier 10. After reaching the bottom of tubular air passageway 32 the air is directed radially inward and is ultimately expelled into the internal chamber 12 through the annular air inlet 36 into the slag passageway 70 that lies beneath the slag outlet 20 of the main combustion region 14 where it then travels upward into the main combustion region through the slag outlet. The guide vanes 38 located in the tubular air passageway 32 near the annular air inlet 36 convert the circumferential motion of the air into radial motion as the air nears the annular air inlet that discharges the air into the internal chamber 12. Water may also be discharge into the air via the water injection system 46 to provide additional hydrogen and oxygen for the gasification process.

The pressure and temperature within the main combustion region 14 is maintained at levels that are sufficiently high enough to cause the ash generated from the gasification process to liquefy into slag. The gasified fuel exits the gasifier 10 via the gasified-fuel outlet tube 28. In contrast, gravity causes the liquified slag to flow along the inner surfaces of the ceramic wall 16, and to ultimately flow out of the slag outlet 20 at the base of the main combustion region 14. As the liquified slag flows out of the slag outlet 20, the air or air and water mixture chills the slag and solidifies it, thereby forming stalactites of solidified slag that hang from the slag outlet. Such slag stalactites continue to grow downward in the slag passageway 70 until they ultimately extend at least partially through the openings 60 of the breaking members 58 of the slag breaker 52. Periodically, the actuators 66 of the slag breaker 52 are triggered to actuate the breaking members 58. Preferably, the actuators 66 are triggered in an alternating manner rather than simultaneously. More specifically, one of the actuators 66 is preferably triggered in manner causing one of the breaking members 58 to translate horizontally in first direction from a neutral position by approximately two inches, to thereafter return to neutral position, to thereafter translate negative two inches in the first direction, and to thereafter return to the neutral position. After that has occurred, the other of the actuators 66 is preferably triggered in manner causing the other breaking member 58 to translate horizontally in second direction (perpendicular to the first direction) from a neutral position by approximately two inches, to thereafter return to neutral position, to thereafter translate negative two inches in the second direction, and to thereafter return to the neutral position. This movement of the breaking members 58 causes the cylindrical faces 68 of the breaking members to contact and break the solidified slag stalactites in a manner creating chunks of solidified slag that fall through the openings 60 of the breaking members and downward into the slag collection region 72 of the gasifier 10. In the slag collection region 72, the chunks of solidified slag are deflected by the slag chute 54 into the slag discharge auger 56. The size of the chunks of solidified slag allows the slag chunks to be easily discharged from the gasifier 10 via the slag discharge auger 56.

In view of the foregoing, it should be appreciated that the invention achieves the several advantages over prior art gasifiers. For example, it should be appreciated that the present invention provides an efficient way of removing slag from gasifiers in a manner such that the slag build-up reaches an equilibrium and eliminates the need to periodically shutdown the gasifier to remove solidified slag accumulations.

As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

It should also be understood that when introducing elements of the present invention in the claims or in the above description of exemplary embodiments of the invention, the terms "comprising," "including," and "having" are intended to be open-ended and mean that there may be additional elements other than the listed elements. Additionally, the term "portion" should be construed as meaning some or all of the item or element that it qualifies. Moreover, use of identifiers such as first, second, and third should not be construed in a manner imposing any relative position or time sequence between limitations. Still further, the order in which the steps of any method claim that follows are presented should not be construed in a manner limiting the order in which such steps must be performed.

What is claimed is:

1. A method comprising:

gasifying fuel in an internal chamber of a gasifier in a manner creating liquefied slag within the internal chamber;

solidifying the liquefied slag into solidified slag within the gasifier;

operating an actuator in a manner causing a slag breaker of the gasifier to move from a neutral position into contact with the solidified slag in a manner causing the solidified slag to break into chunks of solidified slag that then fall into a slag collection region of the gasifier, wherein the slag breaker comprises an opening through which the solidified slag extends prior to being broken into chunks of solidified slag by the movement of the slag breaker, and the actuator causes the slag breaker to move in one direction from the neutral position and thereafter in an opposite direction from the neutral position.

2. A method in accordance with claim 1 wherein slag breaker encircles the opening.

3. A method in accordance with claim 2 wherein the opening is circular.

4. A method in accordance with claim 1 wherein the slag breaker comprises first and second ring-shaped breaking members that each surround the opening.

* * * * *